US010234208B2

(12) United States Patent
Löfdahl et al.

(10) Patent No.: US 10,234,208 B2
(45) Date of Patent: Mar. 19, 2019

(54) TUBULAR HEAT TREATMENT APPARATUS WITH IMPROVED ENERGY EFFICIENCY

(71) Applicant: TETRA LAVAL HOLDINGS & FINANCE S.A., Pully (CH)

(72) Inventors: Helén Löfdahl, Hjarup (SE); Magnus Gullberg, Malmo (SE)

(73) Assignee: TETRA LAVAL HOLDINGS & FINANCE S.A., Pully (CH)

( * ) Notice: Subject to any disclaimer, the term of this patent is extended or adjusted under 35 U.S.C. 154(b) by 616 days.

(21) Appl. No.: 14/764,483

(22) PCT Filed: Jan. 22, 2014

(86) PCT No.: PCT/EP2014/051212

§ 371 (c)(1),
(2) Date: Jul. 29, 2015

(87) PCT Pub. No.: WO2014/118048

PCT Pub. Date: Aug. 7, 2014

(65) Prior Publication Data

US 2015/0362257 A1 Dec. 17, 2015

(30) Foreign Application Priority Data

Jan. 30, 2013 (SE) ..... 1350102

(51) Int. Cl.

*F28D 7/00* (2006.01)
*F28D 7/10* (2006.01)
*F28D 21/00* (2006.01)

(52) U.S. Cl.

CPC ..... *F28D 7/0066* (2013.01); *F28D 7/103* (2013.01); *F28D 2021/0042* (2013.01); *F28F 2210/08* (2013.01); *F28F 2270/00* (2013.01)

(58) Field of Classification Search

CPC ... F28F 2265/10; F28F 2270/00; F16L 59/00; F16L 59/02; F16L 59/023; F16L 59/024;
(Continued)

(56) References Cited

U.S. PATENT DOCUMENTS 2,586,998 A * 2/1952 Schlenz ..... C02F 3/28 122/149
2,978,226 A * 4/1961 White ..... F28D 7/1646 165/161

(Continued)

FOREIGN PATENT DOCUMENTS

EP 1 742 006 A1 1/2007
EP 2 157 390 A2 2/2010

(Continued)

OTHER PUBLICATIONS

International Search Report (PCT/ISA/210) dated May 12, 2014, by the Swedish Patent Office as the International Searching Authority for International Application No. PCT/EP2014/051212.

*Primary Examiner* — Tho V Duong
(74) *Attorney, Agent, or Firm* — Buchanan Ingersoll & Rooney PC

(57) ABSTRACT

A tubular heat treatment apparatus comprising a number of tubes arranged in a number of groups. Each of the number of groups are arranged to process product within a predetermined temperature interval. At least one of the groups is swept by a sheet such that heat transfer to or from the group is reduced.

14 Claims, 6 Drawing Sheets

(58) Field of Classification Search
CPC ..... F16L 59/025; F16L 59/029; F16L 59/12; F16L 59/14; F16L 59/121; F16L 59/163; F16L 59/181; F28D 7/0066; F28D 7/103
See application file for complete search history.

(56) References Cited

U.S. PATENT DOCUMENTS

| | | | | | |
|---|---|---|---|---|---|
| 2,995,343 | A * | 8/1961 | Gardner | F22B 1/063 | 122/483 |
| 3,074,480 | A * | 1/1963 | Brown, Jr. | F28D 7/10 | 165/143 |
| 4,433,721 | A * | 2/1984 | Biaggi | F28F 9/0135 | 165/162 |
| 4,957,160 | A * | 9/1990 | Raleigh | F28F 9/22 | 165/159 |
| 5,560,166 | A * | 10/1996 | Burke | F16J 15/065 | 52/218 |
| 2006/0045828 | A1* | 3/2006 | Aaron | B01J 8/0496 | 422/629 |
| 2008/0308264 | A1* | 12/2008 | Antonijevic | F28D 1/05375 | 165/165 |
| 2013/0141907 | A1* | 6/2013 | Doi | C08J 5/043 | 362/235 |

FOREIGN PATENT DOCUMENTS

| | | | |
|---|---|---|---|
| JP | 01-172280 | A | 7/1989 |
| KR | 101059322 | B1 * | 4/2011 |

* cited by examiner

TUBULAR HEAT TREATMENT APPARATUS WITH IMPROVED ENERGY EFFICIENCY

TECHNICAL FIELD

The invention generally relates to the field of heat transfer, more particularly to tubular heat treatment apparatus, such as a tubular heat exchanger or tubular holding cell, with improved energy efficiency.

BACKGROUND OF THE INVENTION

Today, it is a common approach within the food processing industry as well as other industries to use tubular heat exchangers for heat treatment purposes.

Within the food processing industry it is common to have the tubular heat exchanger manufactured in stainless steel. A steel grade of insert tubes and shell tubes, placed outside the insert tubes, can be chosen depending on the product to be processed.

In short, by example, product enters the tubular heat exchanger in the insert tubes at low temperature and is heated by a media flowing in the shell tubes outside the insert tubes. When the product reaches pasteurization temperature it enters a cell either included in the heat exchanger or separate, a tube with a length adjusted to keep the product at pasteurization temperature for a certain time calculated for each product case. After the holding cell, the product starts cooling down; media now flows outside the insert tubes in the shell tubes. Preferably, insert tubes, shell tubes and holding cells are arranged so they can treat different products and cases.

In order to reduce heat transfer, insert tubes and shell tubes used for heating the product can be grouped together, and in the same way insert tubes and shell tubes used for cooling the product can be grouped together. By doing so the heat transfer between different parts within the tubular heat exchanger can be reduced, and hence the energy efficiency can be increased.

Another approach to reduce the energy transfer within the tubular heat exchanger is to insulate the shell tubes by using for example mineral wool or cellular rubber. Since a vast amount of energy is used for heat treatment in e.g. a food processing plant there is a need to reduce this in order to be able to provide heat treatment in a more environmental friendly way.

SUMMARY

Accordingly, the present invention preferably seeks to mitigate, alleviate or eliminate one or more of the above-identified deficiencies in the art and disadvantages singly or in any combination and solves at least the above mentioned problems.

According to a first aspect it is provided a tubular heat treatment apparatus comprising a number of tubes, wherein said number of tubes is arranged in a number of groups, wherein each of said number of groups are arranged to process product within a pre-determined temperature interval, wherein at least one of said number of groups are swept by a sheet, such that heat transfer to or from said at least one of said groups is reduced.

A tubular heat treatment apparatus should be understood to include, but not limited to, a tubular heat treatment apparatus and a tubular holding cell.

The sheet may be coated at least one side with a silicone material.

The sheet may be made of glass fibre.

A first end section and a second end section of said sheet may be fastened together.

The first end section and said second end section can be placed downwards.

The first end section or said second end section may be in contact with another sheet swept around another group of said number of groups.

The other group may in use be placed below said group.

The tubular heat treatment apparatus may further comprise at least one element placed between said group of tubes and said sheet.

The at least one element may in use be placed on top of said group.

The at least one element may be placed in a corner section of said group.

At least two of said number of groups, comprising said at least one of said number of groups, can be swept at least partly by an additional sheet.

The tubular heat treatment apparatus may further comprise a mat filled with insulating material, such as mineral wool, provided between one of a number of covers of said tubular heat treatment apparatus and said tubes.

A first group of said number of groups is arranged to process said product in a first temperature and a second group of said number of groups is arranged to process said product in a second temperature, said first temperature being lower than said second temperature, wherein said first group is in use placed below said second group. This means that it is to be understood that each number of groups may be arranged to individually process product within a pre-determined temperature interval. The pre-determined temperature interval may thus be the same or different for each number of groups.

The tubular heat treatment apparatus can be for food processing.

According to a second aspect it is provided a system comprising a tubular heat according to the first aspect.

According to a third aspect it is provided a sheet arranged for being swept at least partly around said at least one of said number of groups of said tubular heat treatment apparatus according to the first aspect.

The sheet may be coated at least one side with a silicone material.

The sheet may be made of glass fibre.

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, wherein.

DETAILED DESCRIPTION OF PREFERRED EMBODIMENTS

Figure 1A:
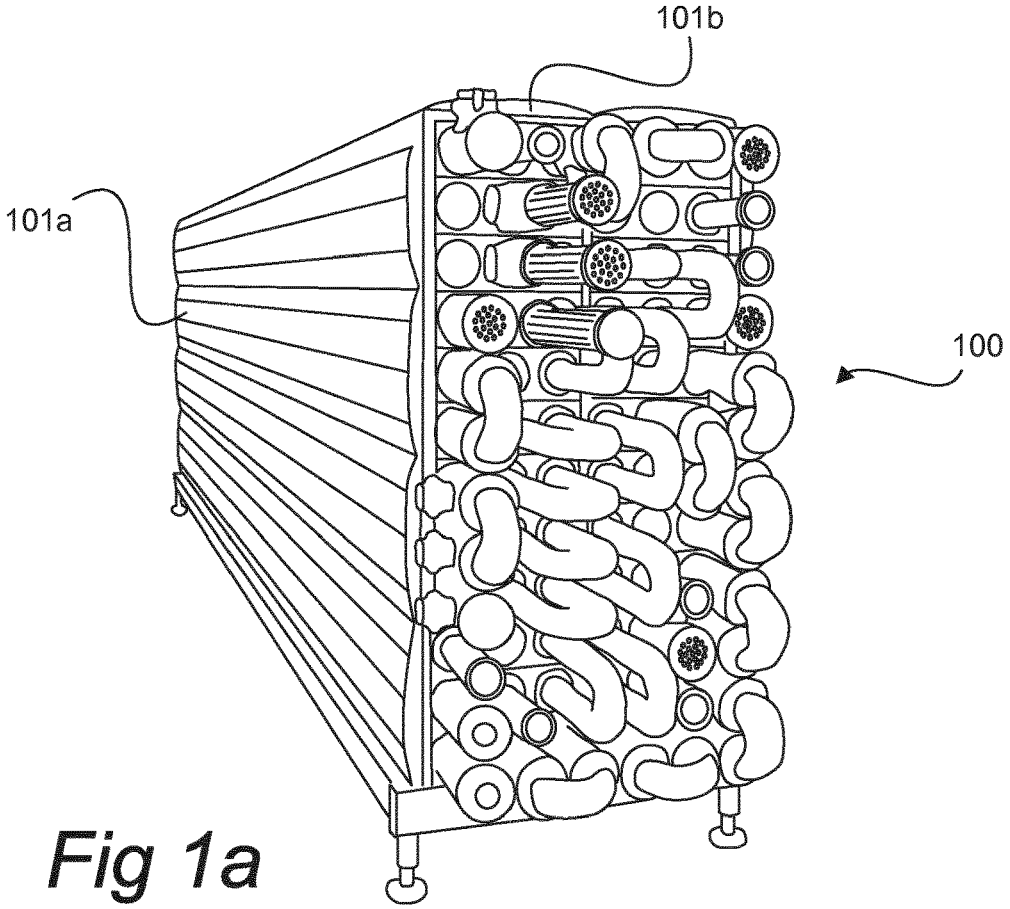
FIGS. 1*a* and 1*b* generally illustrates an example of a tubular heat exchanger.
Figure 1B:
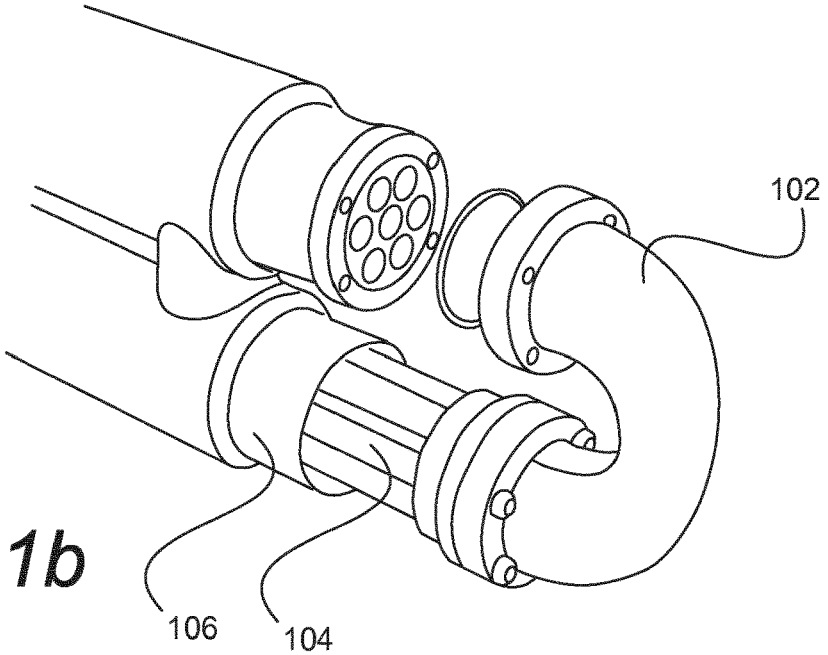

FIGS. 1*a* and 1*b* illustrates an example of a tubular heat exchanger 100, more particularly a Tetra Spiraflo™ marketed by Tetra Pak. As illustrated, a number of tubes are connected to each other via bend pipes 102 providing for a compact design. In the illustrated example, insert tubes 104 are kept in sets and each set is arranged in a bigger pipe referred to as a shell tube 106. The food product is fed through the insert tubes and a heat transfer medium is fed through the shell. In order to keep energy consumption low, it is advantageous to use outgoing product or media, which is to be cooled down, as the heat transfer medium. Such system are often referred to as regenerative systems.

On the sides and on the top of the tubular heat exchanger 100 side covers 101*a* and top covers 101*b* can be placed. During service these can be be removed in order to provide for easy access.

Figures 2, 3:
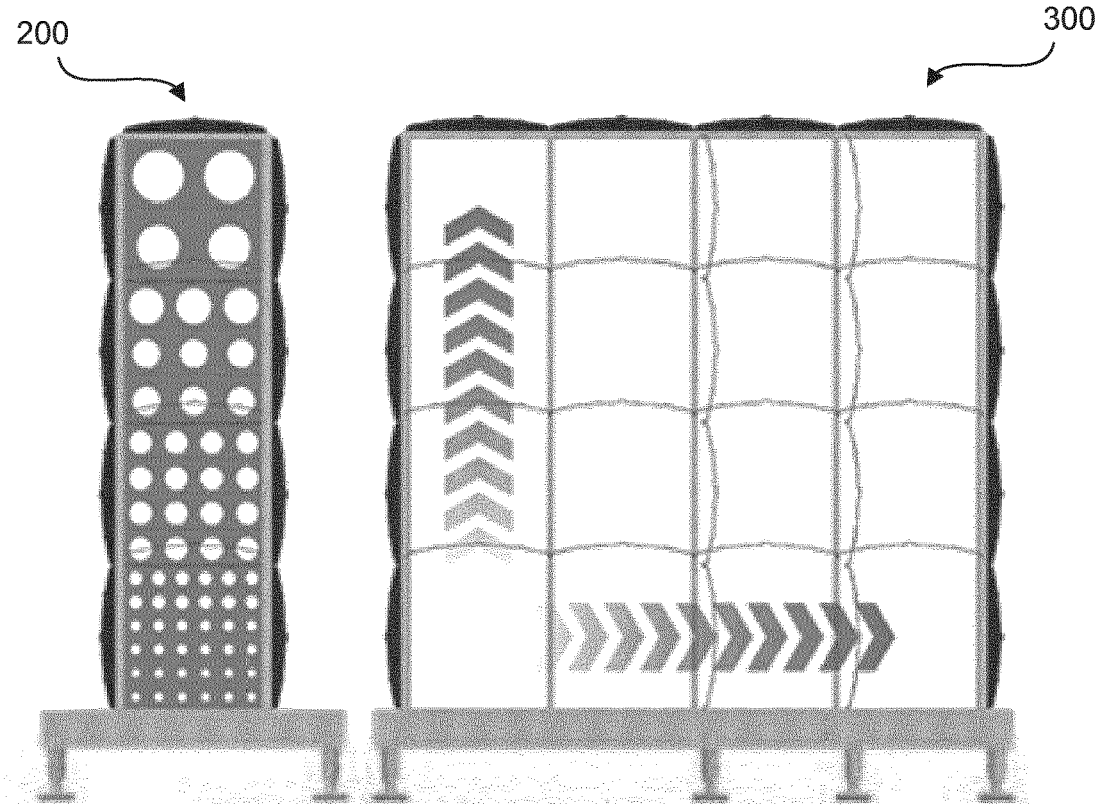
FIG. 2 illustrates an example of a cross sectional view of a tubular heat exchanger.
FIG. 3 illustrates an example of a cross sectional view of another tubular heat exchanger.

FIGS. 2 and 3 illustrate by example cross sectional views of a tubular heat exchanger 200 and a tubular heat exchanger 300, respectively.

As illustrated, each tubular heat exchanger can be designed with different tube and shell dimensions, different configuration and different sizes in order to meet the needs specified e.g. by a food processing company. In order to provide for efficient production the tubular heat exchangers can be built up in modules. As example, the tubular heat exchanger 200 illustrated in FIG. 2 is built up by four modules placed in one column, referred to as a 4×1 tubular heat exchanger. The tubular heat exchanger 300 illustrated in FIG. 3 has modules placed in four columns with four modules in each of the columns, referred to as a 4×4 tubular heat exchanger.

Figure 4:
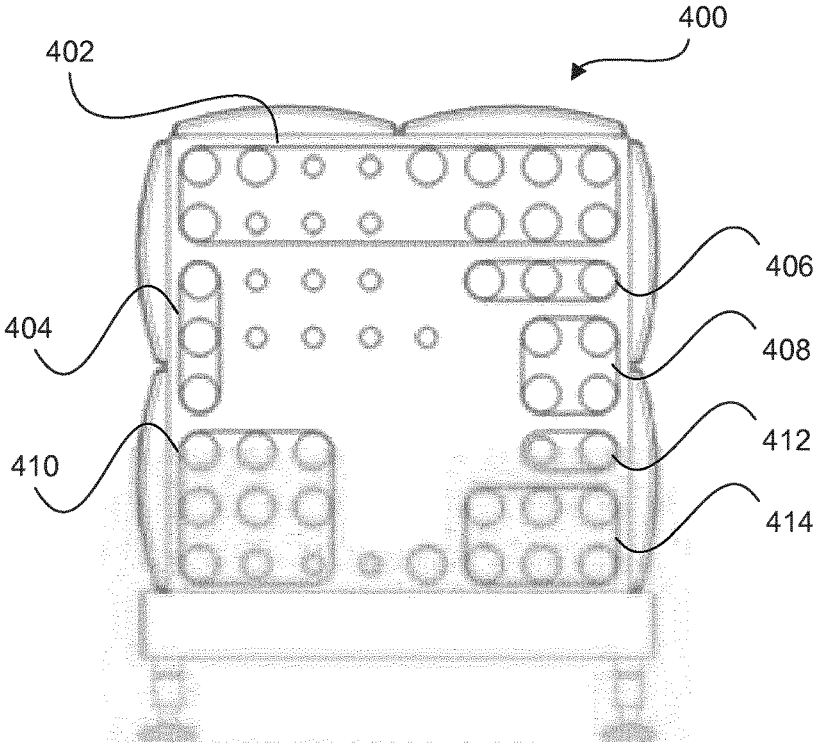
FIG. 4 illustrates an example of a cross sectional view of a tubular heat exchanger with groups swept by sheets.

FIG. 4 illustrates by example a tubular heat exchanger 400 having a number of shell tubes, insert tubes (not illustrated), and tubes used as holding cells, herein the shell tubes and the tubes used as holding cells are together referred to as tubes.

In order to reduce heat transfer from tubes used for heating or holding heated product to tubes used for cooling product, one or several sheets may be used.

As illustrated, a first group of tubes may be swept by a first sheet 402, a second group may be swept by a second sheet 404, a third group may be swept by a third sheet 406, a fourth group may be swept by a fourth sheet 408, a fifth group may be swept by a fifth sheet 410, a sixth group may be swept by a sixth sheet 412 and a seventh group may be swept by a seventh sheet 414.

Due to that hot air is lighter than cold air and thereby move upwards, it is advantageous to have groups of tubes for heating or holding heated product placed above groups of tubes used for cooling or holding cooled product. In this way, heat released from the groups used for heating or holding heated product will not as easily be transferred to the groups used for cooling or holding cooled product.

Figure 5:
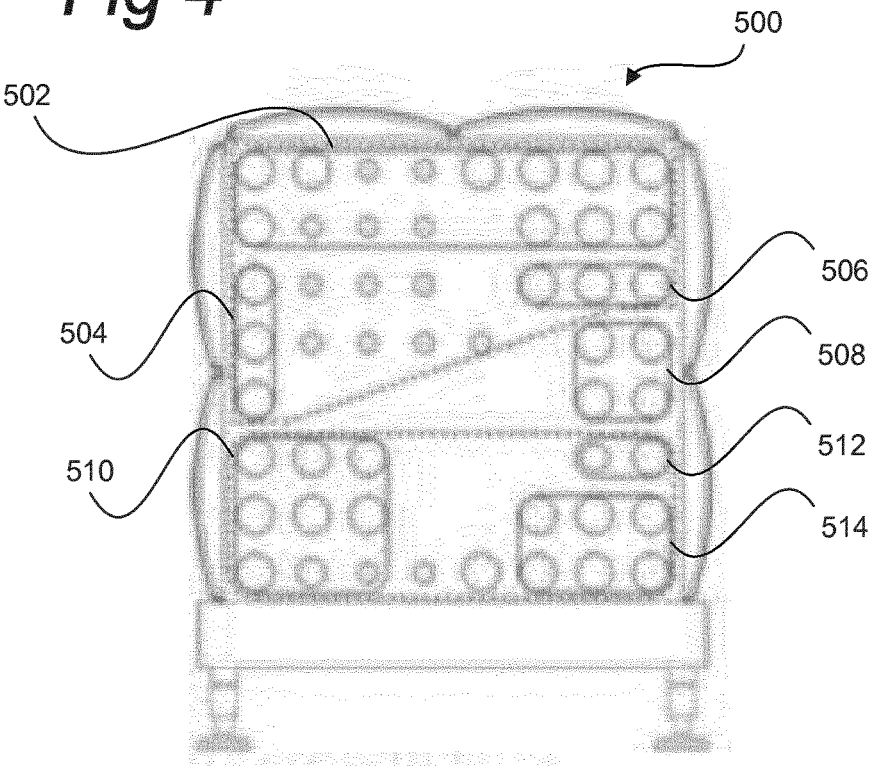
FIG. 5 illustrates another example of a cross sectional view of a tubular heat exchanger with groups swept by sheets.

FIG. 5 illustrates by example a tubular heat exchanger 500 provided with seven groups swept by seven different sheets in a similar way as the tubular heat exchanger 400 illustrated in FIG. 4. More particularly, a first group of tubes may be swept by a first sheet 502, a second group may be swept by a second sheet 504, a third group may be swept by a third sheet 506, a fourth group may be swept by a fourth sheet 508, a fifth group may be swept by a fifth sheet 510, a sixth group may be swept by a sixth sheet 512 and a seventh group may be swept by a seventh sheet 514.

In this example, in order to further prevent heat transfer between groups of tubes with different temperatures, two additional sheets, an eighth sheet 516 and a ninth sheet 518, can be used.

In the illustrated example, the eighth sheet 516 is swept around the first group swept by the first sheet 502, the second group swept by the second sheet 504 and the third group swept by the third sheet 506. The ninth sheet 518 is swept around the fifth group swept by the fifth sheet 510, the sixth group swept by the sixth sheet 512 and the seventh group swept by the seventh sheet 514.

Figure 6:
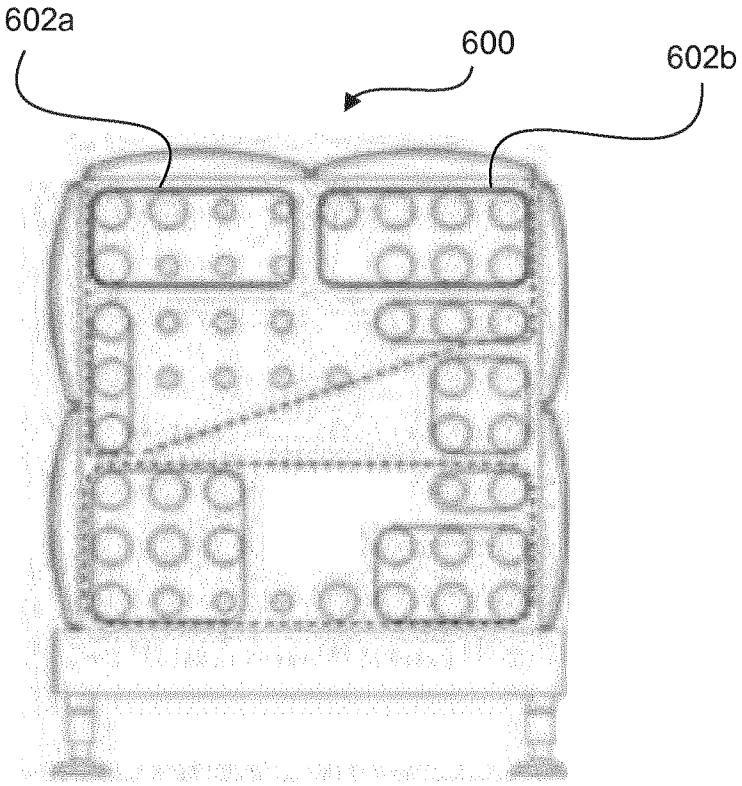
FIG. 6 illustrates still an example of a cross sectional view of a tubular heat exchanger with groups swept by sheets.

FIG. 6 illustrates a tubular heat exchanger 600 similar to the heat exchangers 400, 500 illustrated in FIG. 4 and FIG. 5, but with another set up of the groups of tubes. More particularly, the first group is divided in two different groups 602*a*, 602*b*. How to group the tubes in order to get an energy efficient tubular heat exchanger may be determined e.g. by using simulation tools.

By reducing the heat transfer between different groups within the tubular heat exchangers, as well as the heat transfer between the different groups and the surroundings, a number of advantages can be achieved, for instance:

Energy Saving

Due to that the sheets reduce heat transfer between the tubes used for heating and holding the product heated and the tubes used for cooling less energy for heating as well as for cooling is needed. Further, apart from reducing transfer of heat between different groups, the heat recovery within the tubes for heating and holding the product heated will be improved. Put in other words, excessive heat released from one tube among the tubes may be used for heating another tube among the tubes with a slightly lower temperature. In this way less heating media is needed. In the same way the cooling recovery within the tubes for cooling will be improved. In this way less cooling media is needed.

Reduce Temperature Drop in Holding Cells

By using sheets as described above, the temperature drop in holding cells can be decreased. An effect of this is that a product temperature when entering the holding cell can be lowered. Since high product temperatures affect the product quality this can lead to improved product quality.

Reduce Cover Temperature

Since using sheets as described above will result in less heat transfer to the surroundings this will result in a cooler working environment, thereby reducing costs for cooling the plant. A further effect is that covers of the tubular heat exchanger will be cooler which leads to a safer working environment. More particularly, the risk that operating personnel coming in contact with hot surfaces can be reduced.

Advantages of using sheets as illustrated by example in FIG. 4, FIG. 5 and FIG. 6 are for instance:

Cost Efficiency

Using sheets for sweeping groups of tubes is in many cases more cost efficient compared to prior used techniques, e.g. insulating the tubes individually. One reason for this is that less material is needed for the sheets compared to e.g. a mineral wool filled mat.

Low Assembly Cost

Since the sheets are lighter than mineral wool it is easier for production personnel to lift these. Today, when using mineral wool mats an overhead crane is in many cases used during assembly. Since the sheets is substantially lighter, about ten times, there is not the same need for the overhead crane.

Long Life Time

The sheets can be made of strong material providing for that they will not be needed to be replaced frequently, which is an advantage when determining total cost of ownership.

Low Environmental Impact

Since a lighter material and less material is needed the environmental impact of the tubular heat exchanger as a whole will be reduced.

Low Stock Keeping Cost

The sheets can easily be cut in pieces. Therefore it is possible to keep the sheet material on a roll and cut piece by piece during production. In this way the number of items can be reduced, which provides for more efficient stock keeping.

Hygienic

The sheets can be made of a material not absorbing liquid, thereby providing for that no product will find its way into the sheet. Further, by choosing such a material the sheets can easily be cleaned and made to withstand any cleaning products used.

As further described below, a distance element may be placed on a top section of a group of tubes swept by a sheet thereby forming a roof top like upper part of the sheet with inclined surfaces providing for that liquid does not stay on top of the sheet.

Corrosion

The sheets can be made of a material not inducing corrosion, neither the material itself, nor by causing liquid to stay in contact with the shells for longer times.

Temperature

The sheets can be made of a material withstanding temperatures of 160° C. or above. For instance, by choosing a silicone coated sheet it can withstand temperatures up to 250° C. According to the present invention the silicone coated sheet is thus for example a silicone suitable to be used within the necessary temperature interval. An example thereof is a silicone rubber coating such as a flame retardant an chemical resistant silicone rubber coating.

Inspectability

If the sheets are not fastened in the tubes, the sheets can be pushed to either side and thereby making the tubes possible to access for an operator or service engineer.

An example of a sheet material is Temtex™ 420/SG2 provided by TEMATI. The thickness can be chosen to be 0.45 mm. The material can be waterproof, chloride free material that can withstand 160° C. such as a glass fibre thin fabric coated with thin layers of silicone on each side.

Figure 7:
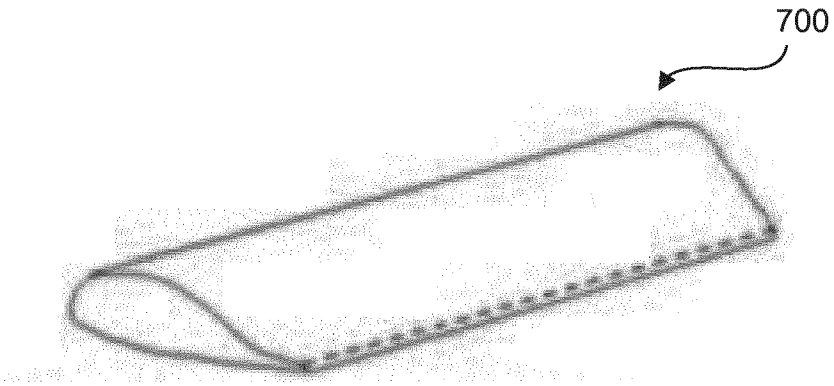
FIG. 7 illustrates an example of a sheet with end section fastened together.

FIG. 7 illustrates an example of a piece 700 of sheet material with two end sections fastened together. The two end sections may be stapled together or fastened by any other method, such as welding, sewing, gluing or taping. An advantage of stapling the two end sections together is that when having the sheet swept around a group of tubes, any liquid will sipper out between the two end sections, provided that the splice is placed downwards.

Figure 8:
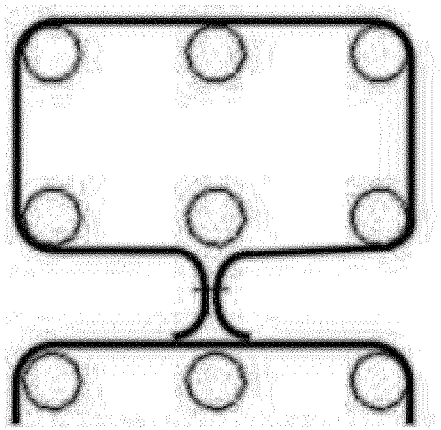
FIG. 8 illustrates an example of a group of tubes swept by a sheet with end sections fastened together and placed downwards.

FIG. 8 illustrates by example a cross sectional view of a group of tubes swept by a sheet that is stapled together. As described above, by arranging end sections downwards liquid can pass through the splice and be seen by an operator or service engineer on the next sweep or on the floor.

Further, an advantage of having end sections being in contact with other another sheet is that air flow between the groups of tubes can be reduced.

Figure 9C:
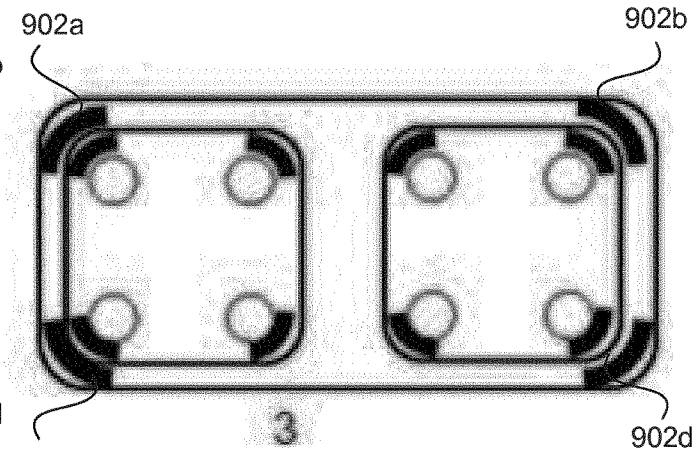
FIG. 9*c* illustrates two groups of tubes as illustrated in FIG. 9*b* with an additional sheet swept around these two groups and with elements in the corner sections for increasing the amount of air held inside the additional sheet.
Figure 9B:
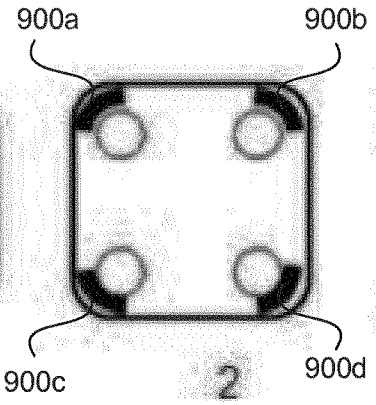
FIG. 9*b* illustrates a group of tubes swept by a sheet with elements placed in corner sections in order to increase the amount of air held inside the sheet.
Figure 9A:
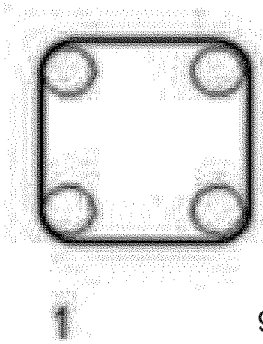
FIG. 9*a* illustrates a group of tubes swept by a sheet.

FIG. 9*a* illustrates a group of four tubes swept by a sheet.

As illustrated in FIG. 9*b*, in order to get more insulating air in a space formed by the sheet, such that radiance from tubes to the surroundings can be lowered, distance elements 900*a*, 900*b*, 900*c*, 900*d* can be provided on the tubes.

A further effect of the distance elements 900*a*, 900*b*, 900*c*, 900*d* is that less space is provided between the group of tubes and covers, not illustrated, providing for that less air flow between the sheets and the covers.

If having an additional sheet swept around the group secondary distance elements 902*a*, 902*b*, 902*c*, 902*d* may be used for providing more insulating air between the group of tubes and the surroundings and for providing less air flow between the sheets and the covers.

Figure 10:
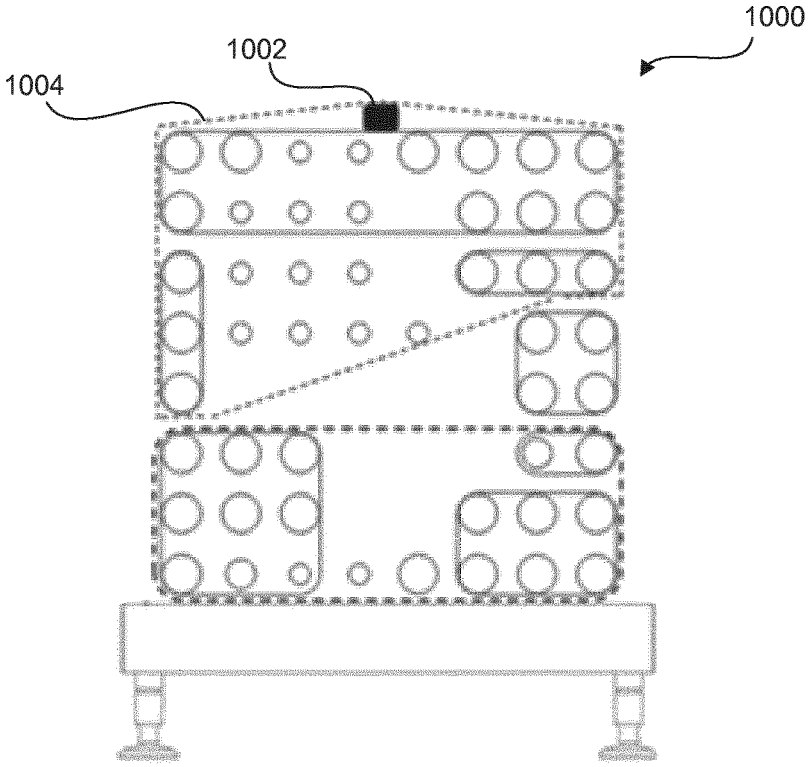
FIG. 10 illustrates an example of a cross sectional view of a tubular heat exchanger with groups of tubes swept by sheets and with an element placed on top of an upper group in order to provide slanted surfaces on an additional sheet swept around a number of groups.

FIG. 10 illustrates a tubular heat exchanger 1000 similar to the tubular heat exchangers illustrated in FIG. 4, FIG. 5 and FIG. 6. However, unlike the tubular heat exchangers illustrated in FIG. 4, FIG. 5 and FIG. 6, the tubular heat exchanger 1000 is provided with a element 1002 placed on top of an uppermost sheet swept around a first group of tubes. An effect of the element 1002 is that an outer sheet 1004 swept around the first group of tubes as well as the element 1002 will have inclined top surfaces providing for that liquid will have less easy to stay on these surfaces, which is an advantage since liquid gathered on these surfaces impact the efficiency of the tubular heat exchanger.

Figure 11:
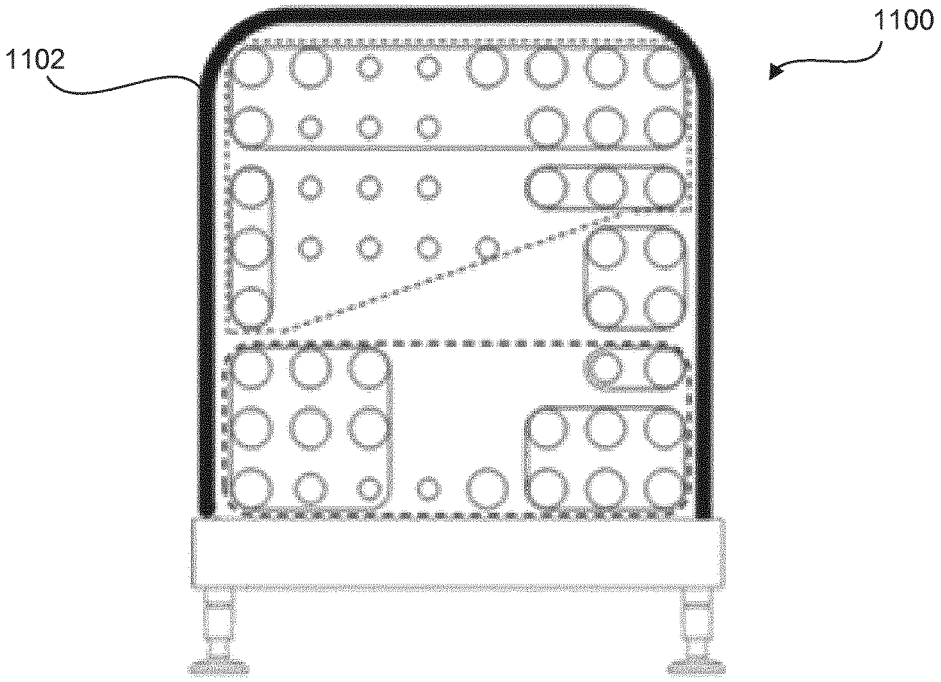
FIG. 11 illustrates an example of a cross sectional view of a tubular heat exchanger with groups of tubes swept by sheets and with a mat filled with insulated material placed outside the tubes.

FIG. 11 illustrates a tubular heat exchanger 1100 similar to the tubular heat exchangers illustrated in FIG. 4, FIG. 5, FIG. 6 and FIG. 9. However, unlike these tubular heat exchangers, this is provided with an insulated mat 1102 outside the swept groups of tubes.

The insulated mat 1002 may be made of mineral wool covered with silicone sheets. An advantage of having the insulated mat 1002 is that it can reduce air flow outside the groups of tubes and the covers and thereby contribute to lower the cover temperature.

As illustrated, the insulated mat can be placed such that a top and sides of the tubes are covered, and leaving a bottom open. An advantage of this is that liquid will have free way to the floor making it easier for service personnel or operators to detect it.

The different features illustrated in FIG. 4, FIG. 5, FIG. 6, FIG. 8, FIG. 9 and FIG. 10 can be combined in different ways depending on the specific conditions for specific situation.

Generally, in a heat exchanger a heating media can be used for heating a product and a cooling media can be used for cooling the product. In a holding cell however the purpose is to hold the product for a certain period of time at a certain temperature, and therefore heating media and cooling media is generally not needed. Therefore, even though tubular heat exchangers have been used as examples above, the same principles may apply to tubular holding cells.

The invention has mainly been described above with reference to a few embodiments. However, as is readily appreciated by a person skilled in the art, other embodiments than the ones disclosed above are equally possible within the scope of the invention, as defined by the appended patent claims.

The invention claimed is:

1. A tubular heat treatment apparatus comprising:

a plurality of tubes;

the plurality of tubes being arranged in a plurality of groups of tubes so that each group of tubes comprises a plurality of the tubes;

each of the groups of tubes being arranged to process product within a pre-determined temperature interval;

a plurality of separate sheets each enclosing a respective space;

each of the spaces enclosed by the respective sheets enclosing one of the groups of tubes such that heat transfer to or from each respective group of tubes is reduced;

each of the groups of tubes being non-concentric with the other groups of tubes; and at least one element placed between one of said groups of tubes and said sheet enclosing said one group of tubes;

wherein said at least one element is placed in a corner section of said one group of tubes.

2. The tubular heat treatment apparatus according to claim 1, wherein each of said sheets is coated at least one side with a silicone material.

3. The tubular heat treatment apparatus according to claim 1, wherein each of said sheets is made of glass fibre.

4. The tubular heat treatment apparatus according to claim 1, wherein a first end section and a second end section of each sheet is fastened together.

5. The tubular heat treatment apparatus according to claim 4, wherein said first end section and said second end section are placed downwards.

6. The tubular heat treatment apparatus according to claim 4, wherein said first end section or said second end section of one of the sheets is in contact with another one of the sheets.

7. The tubular heat treatment apparatus according to claim 6, wherein the group of tubes enclosed by the other sheet is in use placed below said group of tubes enclosed by the one sheet.

8. The tubular heat treatment apparatus according to claim 1, wherein said at least one element is in use placed on top of said one group of tubes.

9. The tubular heat treatment apparatus according to claim 1, wherein at least two of said groups of tubes are enclosed at least partly by an additional sheet.

10. The tubular heat treatment apparatus according to claim 1, further comprising a mat filled with insulating material provided between one of a number of covers of said tubular heat treatment apparatus and said tubes.

11. The tubular heat treatment apparatus according to claim 1, wherein a first group of said tubes is arranged to process said product in a first temperature and a second group of said tubes is arranged to process said product in a second temperature, said first temperature being lower than said second temperature, wherein said first group of tubes is in use placed below said second group of tubes.

12. The tubular heat treatment apparatus according to claim 1, wherein said tubular heat treatment apparatus is for food processing.

13. A system comprising a tubular heat treatment apparatus according to claim 1.

14. A tubular heat exchanger comprising:

a top and sides surrounding an interior;

first, second and third modules positioned in the interior;

the first module comprising a first sheet enclosing a first space in which is enclosed a plurality of first tubes arranged to process product within a pre-determined temperature interval;

the second module comprising a second sheet enclosing a second space in which is enclosed a plurality of second tubes arranged to process product within a pre-determined temperature interval;

the third module comprising a third sheet enclosing a third space in which is enclosed a plurality of third tubes arranged to process product within a pre-determined temperature interval;

an additional sheet enclosing an additional space;

the first module, including the first sheet and the first tubes, being enclosed within the additional space;

the second module, including the second sheet and the second tubes, being enclosed within the additional space; and the third module, including the third sheet and the third tubes, being positioned outside the additional space.

* * * * *